US009027375B2

(12) United States Patent
Hennig et al.

(10) Patent No.: US 9,027,375 B2
(45) Date of Patent: May 12, 2015

(54) APPARATUS AND METHOD FOR SHOT PEENING OF BLADE MOUNTING AREAS ON A ROTOR ARRANGEMENT DISC

(71) Applicants: Rolls-Royce Deutschland Ltd & Co KG, Blankenfelde-Mahlow (DE); Straaltechniek International B.V., AA Oosterhout (NL)

(72) Inventors: Wolfgang Hennig, Hille (DE); Marco Klijsen, cm Kaatsheuvel (NL)

(73) Assignees: Rolls-Royce Deutschland Ltd & Co KG (DE); Straaltechniek International B.V. (NL)

( * ) Notice: Subject to any disclaimer, the term of this patent is extended or adjusted under 35 U.S.C. 154(b) by 0 days.

(21) Appl. No.: 14/480,030

(22) Filed: Sep. 8, 2014

(65) Prior Publication Data

US 2015/0068262 A1 Mar. 12, 2015

(30) Foreign Application Priority Data

Sep. 11, 2013 (EP) ..... 13 183 938

(51) Int. Cl.

| | |
|---|---|
| ***B24C 3/16*** | (2006.01) |
| ***B24C 3/32*** | (2006.01) |
| ***B24C 1/10*** | (2006.01) |
| ***B24C 7/00*** | (2006.01) |
| ***C21D 7/06*** | (2006.01) |
| ***B21D 31/06*** | (2006.01) |
| ***B24B 39/00*** | (2006.01) |

(52) U.S. Cl.

CPC ... *B24C 3/32* (2013.01); *B24C 1/10* (2013.01); *B24C 7/00* (2013.01); *C21D 7/06* (2013.01); *B24C 3/325* (2013.01); *B21D 31/06* (2013.01); *B24B 39/006* (2013.01)

(58) Field of Classification Search

CPC ..... B24C 1/10; B24C 3/325; B24C 31/06; C21D 7/06; B24B 39/006

USPC ..... 239/690, 697, 698; 72/53

See application file for complete search history.

(56) References Cited

U.S. PATENT DOCUMENTS 5,307,661 A * 5/1994 Fink et al. ..... 72/53
5,622,313 A * 4/1997 Lader et al. ..... 239/3

(Continued)

FOREIGN PATENT DOCUMENTS

DE 102008010847 8/2009
EP 1621288 2/2006

OTHER PUBLICATIONS

European Search Report dated Jan. 9, 2014 from counterpart application No. 13183938.3.

*Primary Examiner* — David B Jones
(74) *Attorney, Agent, or Firm* — Timothy J. Klima; Shuttleworth & Ingersoll, PLC

(57) ABSTRACT

An apparatus for shot peening blade mounting areas on a disc of a rotor includes a peening nozzle unit which streams shot peening media along a longitudinal axis. The unit includes a nozzle outlet which extends at least partially in a circumferential direction of the unit, and a deflection arrangement with a deflection area for the media. The deflection area is at least partially cone or half-hyperboloid shaped, such that the media passes the nozzle outlet over an angle range in circumferential direction after being deflected by the deflection arrangement. A method for shot peening the blade mounting areas positions the unit in a slot profile of a blade mounting area, and guides the unit along the contour of the slot profile with the nozzle outlet facing the contour of the slot profile to approximately uniformly peen the contour of the slot profile.

17 Claims, 4 Drawing Sheets

(56) References Cited

U.S. PATENT DOCUMENTS

| | | | | |
|---|---|---|---|---|
| 5,678,770 | A * | 10/1997 | Shah | 239/690 |
| 5,850,976 | A * | 12/1998 | Robidoux | 239/698 |
| 6,464,570 | B1 | 10/2002 | Shaw | |
| 6,467,705 | B2 * | 10/2002 | Robidoux | 239/697 |
| 8,256,117 | B2 * | 9/2012 | Hennig | 29/889.7 |
| 2009/0325468 | A1 | 12/2009 | El-Wardany et al. | |

* cited by examiner

APPARATUS AND METHOD FOR SHOT PEENING OF BLADE MOUNTING AREAS ON A ROTOR ARRANGEMENT DISC

This application claims priority to European Patent Application No. 13 183 938.3 filed Sep. 11, 2013, the entirety of which is incorporated by reference herein.

FIELD OF THE INVENTION

The invention relates to an apparatus for shot peening of blade mounting areas on a rotor arrangement disc by means of a shot peening media as described in the claims, and to a method for controlled shot peening of blade mounting areas on a disc of a rotor arrangement as described in the claims.

BACKGROUND OF THE INVENTION

Rotors of gas turbines, in particular aircraft gas turbines, comprising a rotor disc and blades arranged in circumferential direction around the disc are widely known from practical experience. Typical blades are inserted with a dovetail shaped blade root into also dovetail shaped blade mounting areas on the disc. The dovetail of a turbine blade typically includes corresponding pairs of upper and lower dovetail lobes or tangs in a fir tree configuration. Correspondingly, the perimeter of the rotor disk includes a row of axial dovetail slots defined between corresponding disk posts having complementary upper and lower supporting lobes or tangs.

In order to make the blade mounting areas durable and failsafe it is known to strain-harden the surface of the blade mounting areas by shot peening. With this method, a for example ball-shaped shot peening media is blasted or peened, respectively, with high velocity against the surface of the blade mounting area. Said method allows the improving of the mechanical features of the component and the inducing of inherent compressive stress into the surface of the component such that the danger of crack formation and propagation in the component is reduced, and the fatigue strength and the life time of the blade mounting areas are increased.

Due to the contour of the blade mounting area profile like a dovetail or a fir-tree profile, there is a very limited accessibility for a shot peening device. Currently, shot peening of blade mounting areas is performed by using nozzles which are fitted on specific retaining fixtures and peen the blade mounting areas from the outside with a shower-like media stream. During the peening, the peening stream of the nozzles is directed substantially perpendicular to a slot bottom of the blade mounting area. Due to the unique contour shape of the blade mounting area, several areas are hit very well by the peening stream, however some very poorly. An area of difficult accessibility are the pressure flanks of the blade mounting area which are hit by the shot peening media in particular via rebounds from the slot bottom. Therefore, peening with standard outside peening nozzles from outside the component results in a non-uniform peening treatment since the slot bottom and the pressure flange are unequally exposed to the peening stream. In particular for dovetail profiles the unequal alignment of the pressure flange and the slot bottom against the peening stream is a determining factor.

For providing sufficient strengthening of the pressure flanks with shot peening, it is known to peen the slot bottom very intensively, so that the pressure flanks are peened by the rebounds from the slot bottom with a desired intensity. However, this method may result in a damaging of the slot bottom. Further, no uniform shot peening treatment of the whole blade mounting area in terms of peening intensity, peening coverage, originated surface roughness and residual stresses in the component surface is possible due to the unfavorable hit angle of the peening stream onto the blade mounting area surface.

From DE 10 2008 010 847 A1 it is known to shot peen blades of blade integrated discs (blisks) with a dual-nozzle unit from a suction side and a pressure side of the blade in one step. For making that possible each peening nozzle has a planar deflection area arranged with an angle to a longitudinal axis of each peening nozzle which redirects peening shot media from moving mainly along the longitudinal axis to a direction essentially vertically to the longitudinal axis. Therefore, the peening shot media can be shot from both sides simultaneous against the both sides of the surface of the blade.

Ultra-Sonic-Peening is another possible method to strengthen the surface of a blade mounting area. With this method, the treated component surface and a chamber create a hermetically sealed area where an Ultra-Sonic-Peening source imparts a small volume media stream on the part surface randomly, thereby strengthening it. It is a disadvantage of this method that material damages may occur due to the rather big size of the peening elements which may cause deformations in areas with thin material. Further, applying this method is quite costly as for each type of contour a separate chamber is required.

SUMMARY OF THE INVENTION

It is an object of the present invention to provide an apparatus and a method for shot peening of blade mounting areas on a rotor arrangement disc by which a more uniformly strengthened surface of the blade mounting area can be achieved in a simple manner and preferably in one process step.

The object is achieved by the present invention with an apparatus and method according to the features described herein.

Further advantages, features, and measures are listed herein. The features and measures listed herein can be combined with one another in advantageous ways.

According to the present invention an apparatus for shot peening of blade mounting areas on a disc of a rotor arrangement comprises a peening nozzle unit which is operatively connectable with a movement device and allows the streaming of a shot peening media along a longitudinal axis from a first end to a second end of the peening nozzle unit, wherein the peening nozzle unit comprises a nozzle outlet which extends at least partially in circumferential direction of the peening nozzle unit, and wherein the peening nozzle unit comprises a deflection arrangement with a deflection area for the shot peening media. The deflection area is at least partially cone or half-hyperboloid shaped over at least a part of the circumferential direction of the peening nozzle unit, such that shot peening media streaming in direction of the longitudinal axis of the peening nozzle unit is passing the nozzle outlet over an angle range in circumferential direction after being deflected by the deflection arrangement. The deflection arrangement is designed as a separate component, and is connected to a cross-member of the peening nozzle unit which is arranged transverse to the longitudinal axis of said nozzle unit. The cross-member forms the second end of the peening nozzle unit and is connected to a particularly cylindrical shaped peening media nozzle base of the nozzle unit via a web.

The shot peening method according to the invention uses a peening nozzle unit of an apparatus for shot peening of blade mounting areas. This peening nozzle unit is positioned in a slot profile of the respective blade mounting area, and is controlled guided along the contour of the slot profile with a nozzle outlet facing the contour of the slot profile such that the contour of the slot profile is uniformly or at least approximately uniformly peened.

With using the invention, a blade mounting area profile can be entirely and uniformly impacted by the peening stream, and therefore, uniformly peened. The blade mounting area can be simultaneously peened within its profile cross-section at its pressure flanges, the radius between pressure flange and a slot bottom, and the slot bottom itself with identical peening parameters, i.e. for example a hit angle of the shot peening media stream to the pail surface, and the distance from the nozzle outlet to the part surface. Each blade mounting area can be peened individually with identical peening parameters.

By use of the invention the peening media stream can be guided directly and controlled onto the part surface without turbulence and peening shadows, and the entire profile of the blade mounting area, in particular a typical dovetail or fir tree profile can be peened uniformly from inside the profile.

The inventive deflection arrangement can be manufactured in a simple manner at low costs, and can be fixed to the cross-member of the peening nozzle unit by appropriate fastening means, like a screw for example.

The at least partially cone or mushroom-like half-hyperboloid shaped deflection area of the peening nozzle unit allows advantageously the peening of a wide angle range of the blade mounting area in a single process step. Thus, a uniform peening result in terms of peening intensity, peening coverage, originated surface roughness and residual stresses in the component surface is achieved in a short process time.

Compared to Ultra-Sonic-Peening the presented apparatus and method are cost saving and applicable for various geometric forms of blade mounting areas. To strengthen the part surface with Ultra-Sonic-Peening, relatively large media are necessary to create the required kinetic energy. Due to the smaller size of the peening media, the invention allows the treatment of smaller fillet radii. In addition, small part edges can be treated without danger to be deformed by large media.

In a preferred embodiment of the apparatus according to the invention, the full circumference of the deflection arrangement is provided with the deflection area. Hereby all surfaces of the blade mounting area profile including the slot bottom, the pressure flanks and the radii between slot bottom and pressure flanks can be strain-hardened when inserting the nozzle unit into the profile of the blade mounting area and leading therein in longitudinal extension direction of the blade mounting area.

Advantageously, the deflection arrangement is designed as an at least substantially rotation-symmetric, in particular full rotation-symmetric component in order to achieve an utmost uniformly distributed deflection of the peening shot media. Hereby, the peening elements of the shot peening media comprise substantially the same velocity and energy, and an interaction of the peening elements as well as a change of their characteristics after deflection can be avoided. Further, turbulences and peening shadows can be avoided.

It is advantageous if the web covers only a small circumferential area of the nozzle unit. The thinner the web or fillet is designed, the less limited is the effective angle range of the nozzle outlet and thereby the treatment area. For example, the web which can be formed integrally with the cross-member may cover an angle of about 20° or 30° of the perimeter.

In order to achieve a maximum angle of peening media distribution, the nozzle outlet may be formed extending over the full circumference of the nozzle unit with exception of the circumferential area covered by the web or fillet if such one is provided.

The deflection area is preferably inclined towards the longitudinal axis of the nozzle unit in movement direction of the shot peening media by an angle of at least 30°, in particular circa 45°. The smaller the chosen inclination angle, the smaller is the energy loss of the peening media when being deflected at the deflection area. The skilled person may select the deflection angle most appropriate for the respective application in dependence of the desired characteristics of the peening media stream and the desired surface characteristics.

In an advantageous embodiment, the deflection arrangement of the inventive apparatus may comprise an area which extends at least approximately in direction of the longitudinal axis of the nozzle unit, and which comprises a tip directed against the movement direction of the shot peening media. Hereby, an cross section angle of the tip may be in a range between 40° and 60°.

In order to facilitate the joining of the deflection arrangement and the nozzle unit, a chamber-bevel can be provided on the deflection arrangement at its end portion facing the cross-member and/or on the cross-member at its side facing the nozzle outlet.

The deflection arrangement and/or the peening media nozzle base of the nozzle unit is preferably made of hardened steel. An advantageous steel is known in the Register of European Steels under material number 1.2379 X153CrMoV12. The used materials should have a Rockwell hardness higher than 60 HRC.

In a preferred embodiment of the inventive apparatus, the peening nozzle unit is dimensioned for insertion, at least with its deflection arrangement, into a slot profile, particularly with a dovetail-like or fir tree-like contoured cross-section, of the blade mounting area.

For accurate and repeatable process results also on a plurality of blade mounting areas, the movement device or the nozzle device assembled to the movement device, respectively, is preferably connected to a control unit which is programmed according to the geometric parameters of the blade mounting area such that the peening nozzle unit is guided at least with its deflection arrangement within a profile of the blade mounting area along its contour.

In a preferred embodiment of the inventive method, the peening nozzle unit is controlled guided substantially in extension direction of the blade mounting area by controlled driving the movement device. Hereby, the peening nozzle unit can, at least substantially, be aligned with its longitudinal axis to the extension direction of the blade mounting area during peening operation.

Advantageously, the guiding of the peening nozzle unit is performed in dependence of signals of a controlling unit which controls the guiding of the peening nozzle unit according to stored geometric parameters of the blade mounting area profile, in particular dovetail or fir-tree like profiles.

If a peening nozzle unit used with a cone or hyperboloid shaped deflection arrangement joint to other parts of the nozzle unit by a web or fillet covering a part of the perimeter of the nozzle unit and its deflection arrangement, the inventive method is advantageously performed by controlled guiding the nozzle unit within the blade mounting area profile with the fillet on a side of the nozzle unit facing away the surface to be peened.

The features, functions and advantages can be achieved independently in various embodiments of the present disclosure or may be combined in yet other embodiments. Advantageous embodiments as well as a preferred mode of use, and further details and advantages thereof will best be understood by reference to the following description and drawings.

DETAILED DESCRIPTION

Figure 1:
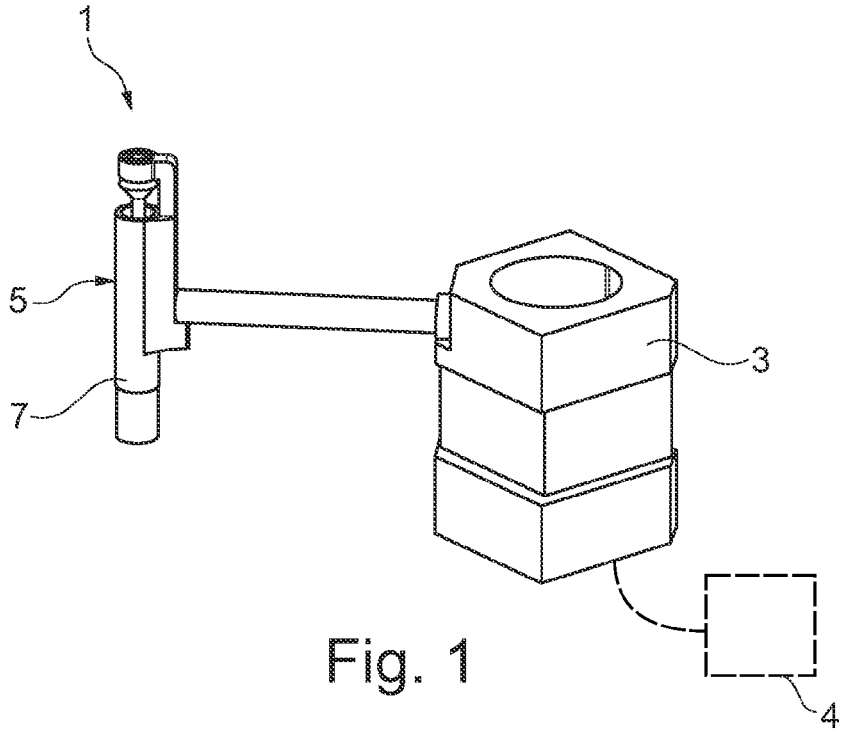
FIG. 1 schematically shows a perspective view of an apparatus for controlled shot peening of blade mounting areas on a rotor arrangement disc of an aircraft gas turbine.

FIG. 1 shows an apparatus 1 for controlled shot peening of part surfaces which comprises a peening nozzle unit 5 connected to a movement device 3. The movement device 3 is holding the peening nozzle unit 5 and guiding said unit preferably by means of a robot, e.g. a typical 6-axis robot, in dependence of geometric data output by a control unit 4 of the movement device 3.

Figure 5:
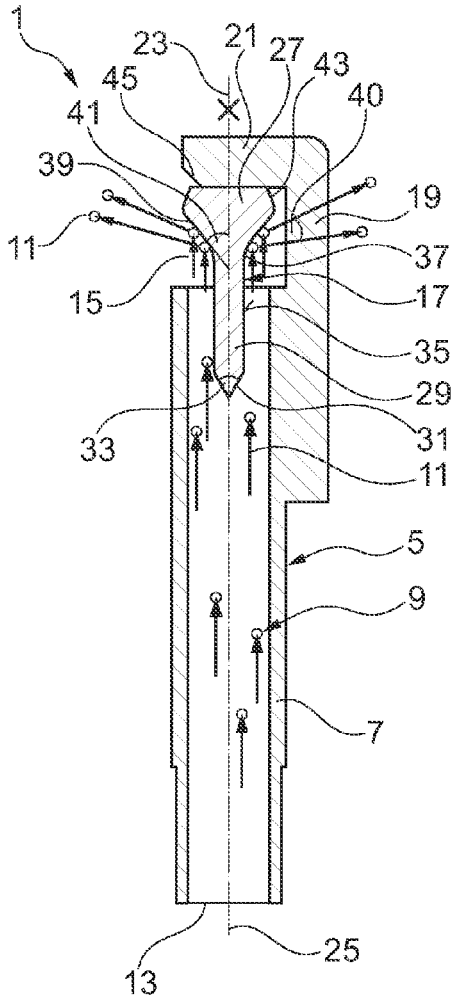
FIG. 5 is a longitudinal cross-section of a peening nozzle unit of the apparatus shown in FIG. 1 to FIG. 4.

The peening nozzle unit 5 comprises a cylindrical peening nozzle base 7 which can be seen e.g. in FIG. 5. The peening nozzle base 7 is designed tube-like for leading a shot peening media 9 which comprises in particular ball-shaped peen particles 11 of metal, glass, ceramic or another appropriate material.

Coming from a (not-shown) peen particles source, the shot peening media 9 is entering the peening nozzle base 7 at an inlet port 13 which is forming a first end of the peening nozzle unit 5. From said inlet port 13, the shot peening media 9 is accelerated within the peening nozzle base 7 substantially parallel to a longitudinal axis 25 of the peening nozzle 5 in direction of a nozzle outlet 15.

In the region of the nozzle outlet 15, a deflection arrangement 17 is provided which has the design of a deflector cone and is fixed by a screw connection 23 to a disc-shaped cross-member 21 which forms a second end of the peening nozzle unit in longitudinal direction. Said cross-member 21 is connected to the peening nozzle base 7 by means of a web or fillet 19. In the cross-section shown in FIG. 5, the cross-member 21 and the web 19 are forming substantially a L-shape, and are integral parts of the peening nozzle 5.

In the shown embodiments, the deflection arrangement 17 is a rotation-symmetric body positioned coaxially to the longitudinal axis 25 of the peening nozzle base 7, i.e. centered in the peening nozzle 5. Further, the deflection arrangement 17 comprises a nail-like shape with a head portion 27 by which the deflection arrangement 17 is connected with the cross-member 21.

On a side of the deflection arrangement 17 facing the first end of the nozzle unit 5 with the inlet port 13, the deflection arrangement 17 comprises a cylindrical shaft 29 which is centered in the peening nozzle base 7 and which comprises a tip or point 31 facing the inlet port 13. Said tip 31 is cone-shaped with a cross-section angle 33 of about 60° in the shown embodiment.

At its head portion 27, the deflection arrangement 17 comprises an inclined deflection area 39 which is joining a cylindric lateral area 35 of the shaft 29 with a transition radius 37.

Here, the deflection area 39 is cone-shaped, i.e. radially inclined towards the longitudinal axis 25 of the nozzle unit 5 by an angle 41 of approximately 45°, and abuts the lateral area 35 of the shaft 29 by a transition radius 37 of R5.

In another embodiment the surface of the deflection area can also be curved radially outwards, forming a mushroom-like half-hyperboloid.

In order to facilitate the inserting of the deflection arrangement 17 into the peening nozzle unit 5 through the nozzle outlet 15, the deflection arrangement 17 is provided with a circular chamber-bevel or bezel 43 at its head portion side 27 facing the cross-member 21. Further, also the cross-member 21 is designed with a chamber-bevel 45 at its edge facing the nozzle outlet 15.

In operation, the shot peening media 9 is streaming from the inlet port 13 in direction of the longitudinal axis 25 of the peening nozzle base 7 towards the deflection area 39 as shown by arrows in FIG. 5. At the deflection area 39, the peen particles 11 of the shot peening media 9 bouncing against the deflection area 39 or the transition radius 37 are deflected and rebounded from the deflection arrangement 17. In the area of the transition radius 37, the blasted peen particles 11 are deflected with different angles towards the longitudinal axis 25 depending on their bouncing point. Therefore, peen particles 11 having a different radial distance towards the longitudinal axis 25 of the nozzle unit 5 are blasted with different deflection angles through the fan-shaped nozzle outlet 15.

In the embodiments shown in the drawings, the inclination of the deflection area 39 and the transition radius 37 are chosen such that the relation between the deflection angle and the impact on the surface of the component, i.e. an energy loss of the peen particles, is an advantageous compromise between these parameters.

The shown deflection arrangement 17 with the deflection area 39 and the radius 37 is a full rotation-symmetric component, thus, the peen particles 11 are deflected by the deflection arrangement 17 around its perimeter in all radial directions. Hereby, the peen particles 11 are approximately uniformly distributed in circumferential direction so that the deflected peen particles 11 are providing approximately the same velocity and energy. Only the few peen particles 11 which are rebounded into direction of the web 19 are prevented by the web 19 from streaming out of the peening nozzle unit 5. Due to the ball-shaped design of the peen particles 11, the web 19 is not significantly strained by abrasion when hit by the peen particles 11. As the peening nozzle unit 5 with the deflection arrangement 17 is made of hardened steel with a Rockwell hardness higher than 60 HRC, the overall wear and abrasion of the peening nozzle unit 5 is very low.

Figure 2:
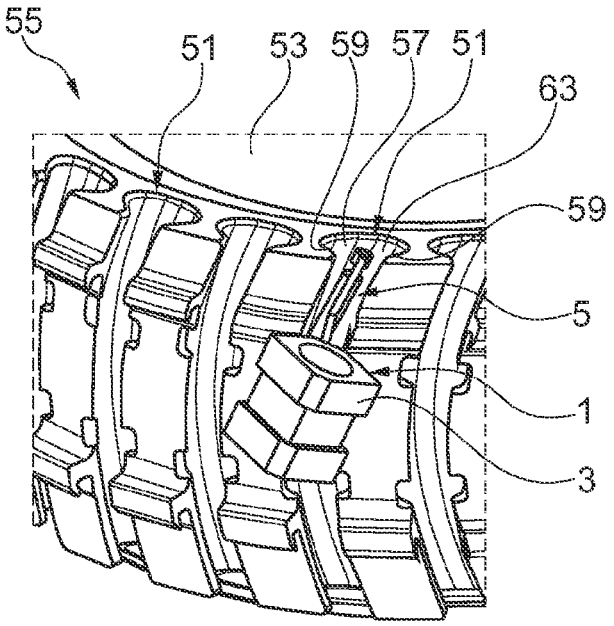
FIG. 2 schematically shows a perspective view of the apparatus of FIG. 1 during peening operation on a blade mounting area of a partly shown disc of a rotor.
Figure 3:
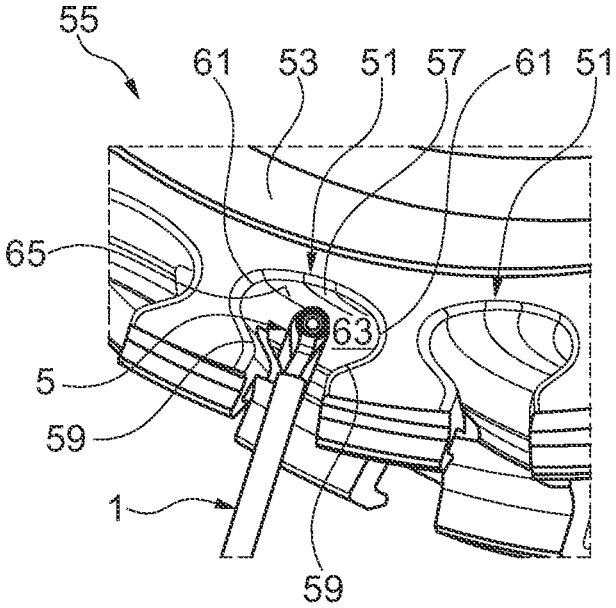
FIG. 3 schematically shows in more details a part of FIG. 3 from another point of view.
Figure 4:
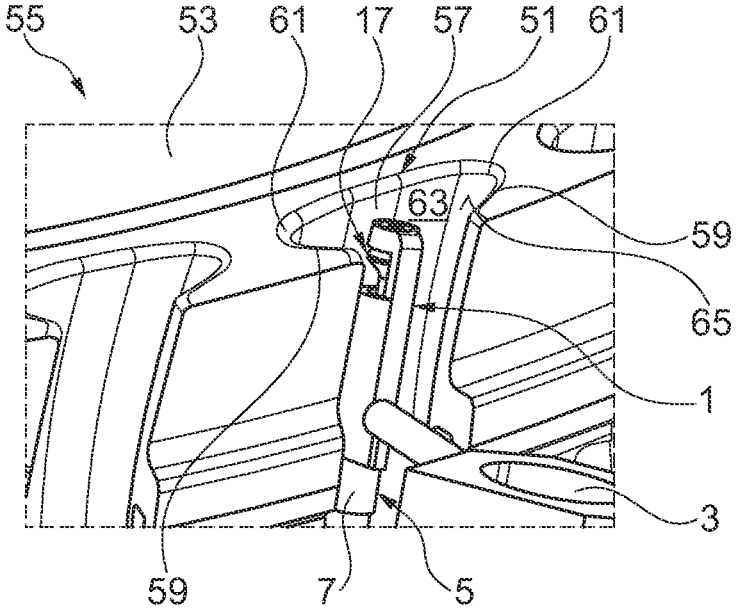
FIG. 4 shows a simplified perspective view of a part of FIG. 2 from a further point of view.

As shown more detailed in FIG. 2 to FIG. 4, the peening nozzle unit 5 is used for the strain-hardening of blade mounting areas 51 on a fan disc or a turbine disc 53 of a rotor arrangement 55 of an gas turbine. Hereby, the peening nozzle unit 5 is controlled guided by the movement device 3 substantially in extension direction of the blade mounting area 51 of the disc 53. Each blade mounting area 51 comprising a slot bottom 57, lateral pressure flanks 59 and a radius 61 connecting the slot bottom 57 with the pressure flanks 59 can be peened from inside by means of the peening nozzle unit 5. For this, the peening nozzle unit 5 is driven by the robot of the movement device 3 into an interior space 63 of the blade mounting area profile such that the peen particles 11 are bouncing against the surfaces of the slot bottom 57, the pressure flanks 59, and the radius 61 after streaming out of the nozzle outlet 15. During this operation, the web 19 is positioned on a side of the nozzle unit 5 facing away from the slot bottom 57. Hereby, a whole surface 65 of the blade mounting area 51 can be peened by the peening nozzle unit 5 in a single movement operation of the peening nozzle unit 5 along the profile contour of the blade mounting area.

After the treatment the endurance strength of the rotor arrangement 55 is improved, and an effective prevention of a crack formation and crack propagation is achieved. Further, as the peen particles 11 are comprising substantially the same velocity and energy, the whole surface 65 of the blade mounting area is highly uniformly peened in regard of peening intensity, peening coverage, originated surface roughness and residual stresses in the component surface 65.

Figure 6:
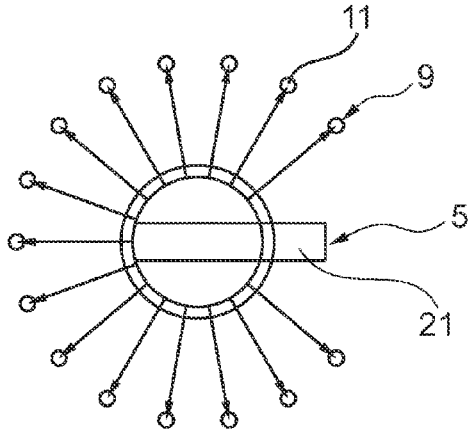
FIG. 6 is a simplified top view of peening nozzle unit of FIG. 5.
Figure 7:
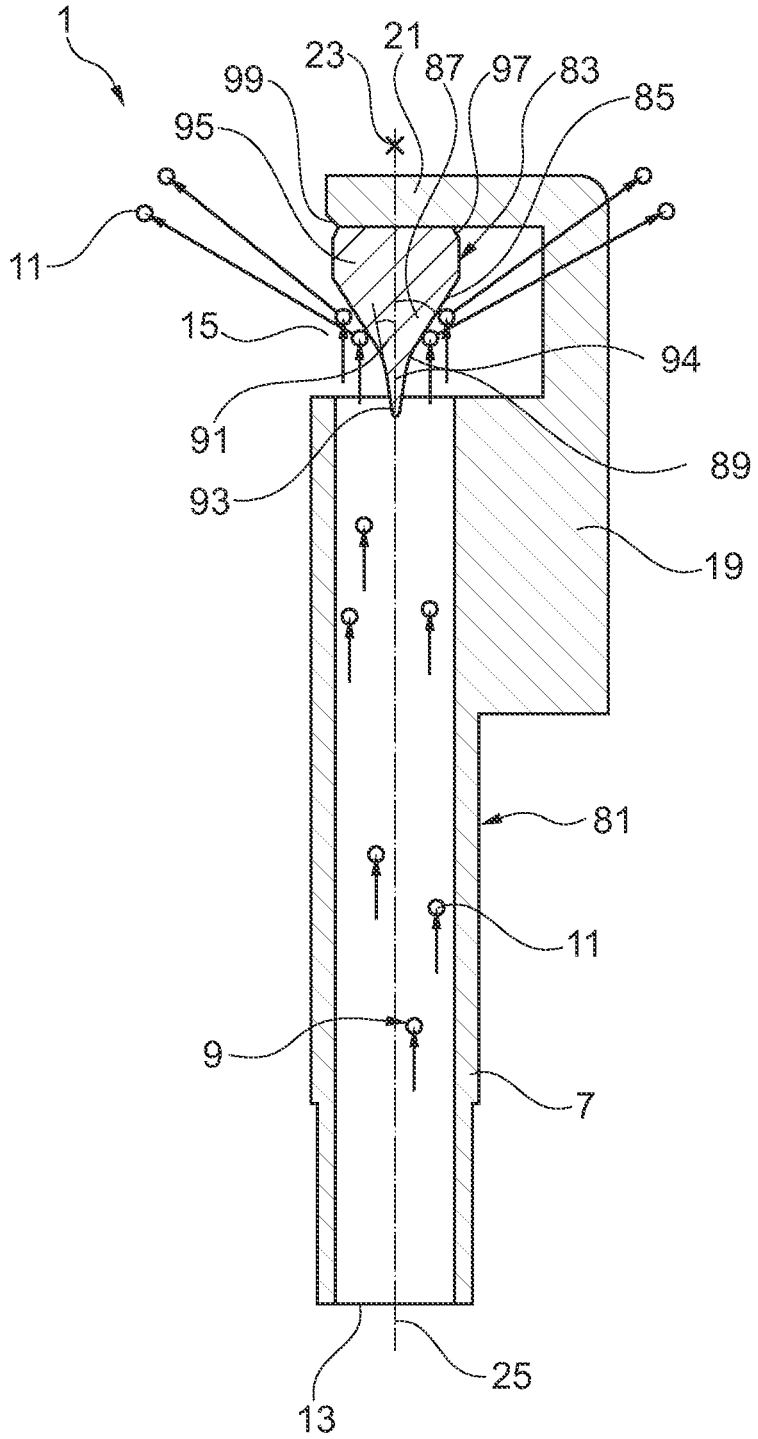
FIG. 7 shows a further embodiment of a peering nozzle unit for the apparatus of FIG. 1 in a longitudinal cross-section.

FIG. 7 shows an alternative embodiment of a peening nozzle unit 81 which comprises a substantially analog structure to that of the peening nozzle unit 5. However, the peening nozzle unit 81 of FIG. 7 differs in the design of a deflection arrangement 83 from the embodiment shown in the previous figures. In the following, only the features are described in detail in which the deflection arrangement 83 differs from the deflection arrangement 27 of the embodiment shown in FIGS. 5 and 6. The further constructional features comply with these of the first embodiment.

The deflection arrangement 83 comprises a deflection area 85 which is inclined towards the longitudinal axis 25 of the peening nozzle unit 83 by an angle 87 of 30°. Thereby, the peen particles 11 are less deflected by the deflection arrangement 83 and are moved with a higher velocity and energy through the nozzle outlet 15 while having the same starting velocity as the peen particles 11 in the previous described embodiment.

Further, the deflection arrangement 83 is more cone-shaped than nail-shaped with a head portion 95 facing the cross-member 21 of the nozzle unit 81 and a shaft 29 which is conically tapered towards the inlet port 13 of the nozzle unit 81 and which is shortened compared to the deflection arrangement of the previous described embodiment. The head portion 95 of the deflection arrangement 83 as well as the cross-member 21 is providing a chamber-bevel 97 or 99 respectively for easier installation.

The shaft 89 comprises a tip 93 which is centered in the peening nozzle base 7 and is shaped with a cross section angle 95 of about 40°. Also here, the surface of the shaft 89 is joining the conical surface of the head portion 95 by a transition radius 95.

The whole peening nozzle unit 81 of FIG. 7 is smaller dimensioned compared to the peening nozzle unit 5 of FIG. 1 to FIG. 6, and therefore, the smaller peening nozzle unit 81 is especially suitable for use in smaller dimensioned blade mounting areas 51.

1 Apparatus
3 Movement device
5 Peening nozzle unit
7 Peening nozzle base
9 Shot peening media
11 Peen particles
13 Inlet port
15 Nozzle outlet
17 Deflection arrangement
19 Web
21 Cross-member
23 Screw connection
25 Longitudinal axis
27 Head portion of the deflection arrangement
29 Shaft of the deflection arrangement
31 Tip of the shaft
33 Tip angle
35 Surface of the shaft
37 Radius
39 Deflection area
40 Angle
41 Angle
43 Chamber-bevel
45 Chamber-bevel
51 Blade mounting area
53 Disc
55 Rotor arrangement
57 Slot bottom
59 Pressure flank
61 Radius
63 Interior space
65 Surface of blade mounting area
81 Peening nozzle unit
83 Deflection arrangement
85 Deflection area
87 Angie of the deflection area
89 Shaft
91 Angle
93 Tip of the shaft
94 Radius
95 Head portion of the deflection arrangement
97 Chamber-bevel
99 Chamber-bevel

The invention claimed is:

1. An apparatus for shot peening a blade mounting area on a disc of a rotor, comprising:

a peening nozzle unit which is operatively connectable with a movement device, and which allows streaming of a shot peening media along a longitudinal axis of the peening nozzle unit from a first end in direction to a second end of the peening nozzle unit, wherein the peening nozzle unit comprises:

a cylindrically shaped peening nozzle base and a circumference;

a nozzle outlet which extends at least partially around the circumference;

a cross-member arranged transverse to the longitudinal axis positioned at the second end of the peening nozzle unit;

a web connecting the cross-member to the cylindrically shaped peening nozzle base;

a deflector with a deflection area for the shot peening media, wherein the deflection area is at least partially cone or half-hyperboloid shaped over at least part of the circumference, such that shot peening media streaming in a direction of the longitudinal axis passes through the nozzle outlet over the at least part of the circumference after being deflected by the deflector, the deflector being separably connected to the cross-member.

2. The apparatus according to claim 1, wherein a full circumference of the deflector is provided with the deflection area.

3. The apparatus according to claim 1, wherein the deflector substantially rotation-symmetric.

4. The apparatus according to claim 1, wherein the web covers only a small portion of the circumference.

5. The apparatus according to claim 1, wherein the nozzle outlet is formed extending over a full circumference of the nozzle unit excepting a portion of the circumference covered by the web.

6. The apparatus according to claim 1, wherein the deflection area is inclined towards the longitudinal axis in a movement direction of the shot peening media by an angle of at least 30°.

7. The apparatus according to claim 1, wherein the deflector comprises an area which extends at least approximately in a direction of the longitudinal axis, and which comprises a tip directed against the movement direction of the shot peening media.

8. The apparatus according to claim 1, wherein a chamber-bevel is provided on the deflector on at least one chosen from an end portion facing the cross-member and the cross-member at a side facing the nozzle outlet.

9. The apparatus according to claim 1, wherein at least one chosen from the deflector and the peening nozzle base is made of hardened steel.

10. The apparatus according to claim 1, wherein the peening nozzle unit is dimensioned for insertion, at least with the deflector, into a slot profile of the blade mounting area.

11. The apparatus according to claim 1, wherein the movement device is connected to a control unit which is programmed according to the geometric parameters of the blade mounting area such that the deflector is guided within a profile of the blade mounting area.

12. The apparatus according to claim 1, wherein the deflector is fully rotation-symmetric.

13. The apparatus according to claim 1, wherein the deflection area is inclined towards the longitudinal axis of the nozzle unit in a movement direction of the shot peening media by an angle of circa 45°.

14. The apparatus according to claim 10, wherein the slot profile has at least one chosen from a dovetail shaped and a fir tree contoured cross-section of the blade mounting area.

15. A method for shot peening of a blade mounting area on a disc of a rotor, comprising:

providing a peening nozzle unit which is operatively connectable with a movement device, and which allows streaming of a shot peening media along a longitudinal axis of the peening nozzle unit from a first end in direction to a second end of the peening nozzle unit, wherein the peening nozzle unit comprises:

a cylindrically shaped peening nozzle base and a circumference;

a nozzle outlet which extends at least partially around the circumference;

a cross-member arranged transverse to the longitudinal axis positioned at the second end of the peening nozzle unit;

a web connecting the cross-member to the cylindrically shaped peening nozzle base;

a deflector with a deflection area for the shot peening media, wherein the deflection area is at least partially cone or half-hyperboloid shaped over at least part of the circumference, such that shot peening media streaming in a direction of the longitudinal axis passes through the nozzle outlet over the at least part of the circumference after being deflected by the deflector, the deflector being separably connected to the cross-member;

positioning the peening nozzle unit in a slot profile of the blade mounting area;

guiding the peening nozzle unit along the slot profile with the nozzle outlet of the peening nozzle unit facing a contour of the slot profile such that the contour of the slot profile is at least approximately uniformly peened.

16. The method according to claim 15, and further comprising guiding the peening nozzle unit substantially in an extension direction of the blade mounting area, wherein the longitudinal axis of the peening nozzle unit is at least substantially aligned to the extension direction of the blade mounting area during a peening operation.

17. The method according to claim 15, and further comprising guiding the peening nozzle unit in dependence of signals of a controlling unit which controls the guiding of the peening nozzle unit according to stored geometric parameters of the blade mounting area profile.

* * * * *